US007873180B2

(12) United States Patent
Vercelli et al.

(10) Patent No.: US 7,873,180 B2
(45) Date of Patent: Jan. 18, 2011

(54) VOICE COIL ACTUATOR

(76) Inventors: Marcelo Vercelli, 17036 NE. 179th St., Woodinville, WA (US) 98072; Daniel C. Wiggins, 20330 77th Ave. West, Edmonds, WA (US) 98026

( * ) Notice: Subject to any disclaimer, the term of this patent is extended or adjusted under 35 U.S.C. 154(b) by 0 days.

(21) Appl. No.: 12/508,274

(22) Filed: Jul. 23, 2009

(65) Prior Publication Data

US 2010/0019584 A1 Jan. 28, 2010

Related U.S. Application Data

(63) Continuation-in-part of application No. 11/412,632, filed on Apr. 26, 2006, now abandoned, which is a continuation of application No. 10/051,735, filed on Jan. 16, 2002, now Pat. No. 7,039,213.

(60) Provisional application No. 61/083,059, filed on Jul. 23, 2008.

(51) Int. Cl.
*H04R 25/00* (2006.01)

(52) U.S. Cl. ..... 381/412; 381/414

(58) Field of Classification Search ..... 381/396, 381/400–402, 406, 411, 412, 414
See application file for complete search history.

(56) References Cited

U.S. PATENT DOCUMENTS

| | | | | |
|---|---|---|---|---|
| 6,175,637 | B1 * | 1/2001 | Fujihira et al. | 381/412 |
| 6,359,996 | B1 * | 3/2002 | Ohashi | 381/401 |
| 6,608,541 | B2 * | 8/2003 | Shiraki et al. | 335/222 |
| 6,639,994 | B1 * | 10/2003 | Proni et al. | 381/406 |
| 6,847,726 | B2 * | 1/2005 | Button et al. | 381/401 |
| 6,904,158 | B1 * | 6/2005 | Ohashi | 381/401 |
| 7,039,213 | B2 * | 5/2006 | Hyre et al. | 381/414 |
| 7,412,071 | B2 * | 8/2008 | Wu | 381/412 |

* cited by examiner

*Primary Examiner*—Suhan Ni
(74) *Attorney, Agent, or Firm*—æon Law; Adam L. K. Philipp

(57) ABSTRACT

Provided herein is a voice-coil motor that includes a magnetic field having at least two displaced regions of higher intensity separated by a region of lesser intensity and a counter-coil disposed within the region of lesser intensity.

19 Claims, 12 Drawing Sheets

VOICE COIL ACTUATOR

CROSS REFERENCE TO RELATED APPLICATIONS

This application is a continuation in part of U.S. application Ser. No. 11/412,632, entitled "SPEAKER DRIVER," with inventors David E. Hyre and Daniel C. Wiggins, and filed on Apr. 26, 2006 (pending), which is a continuation of U.S. application Ser. No. 10/051,735, entitled "SPEAKER DRIVER," with inventors David E. Hyre and Daniel C. Wiggins, and filed on Jan. 16, 2002 (U.S. Pat. No. 7,039,213). This application claims the benefit of priority to U.S. Provisional Application No. 61/083,059, entitled "VOICE COIL MOTOR," with inventors Marcelo Vercelli and Daniel C. Wiggins, filed on Jul. 23, 2008. The above-cited applications are incorporated herein by reference in their entirety, for all purposes.

FIELD

This disclosure relates generally to loudspeakers and, more specifically, to voice-coil type motors used to drive acoustic-radiating diaphragms.

BACKGROUND

It has long been the desire to produce an improved audio speaker, i.e., one that effectively reproduces the input waveform without distortion over a wide frequency range. Audio speakers, or electro-acoustic transducers, are frequently called on to reproduce an input waveform without distortion over a wide frequency range. In general, acoustic speaker systems include a current-carrying conductor, most commonly a coil, that reacts to the flux of a magnet in the motor by axially moving in response to the amount of current in the coil, i.e. the Lorentz force B×I. In general, as the coil moves, it drives a diaphragm, which produces a sound as a vibration in the air.

Distortions in the reproduced (or "transduced") waveform may arise from a number of causes, including non-linear "motor force." The motor force of a voice coil motor is referred to as "BL," which is the magnetic flux density B times the effective length of the wire L in the magnetic field. BL is proportional to motor strength per unit of current—it generates a force of B×L×I. In general, the more constant and flat the BL curve, the more linear the motor and the lower the distortion.

If the coil moves outside the flux of the magnetic circuit, the B field interacting with the current in the coil may be reduced, leading to non-linear motor force. This non-linearity may reduce the axial driving force generated and create movement inconsistent with the desired waveform. This distortion tends to be exacerbated at the lowest frequencies, where large excursions become necessary to produce sound at an acceptable sound pressure level ("SPL") or acoustic volume level. Indeed, the displaced volume required for a given SPL scales as the inverse square of the frequency ($Vd\alpha 1/f^2$), thus requiring a driver to travel four times as far to reproduce a signal at half the frequency. Distortions in the reproduced waveform are minimized when the axial driving force remains constant over the required excursion.

Likewise, the inductance of a coil of wire can induce distortion in the transduced waveform by reducing the current of high frequency signals flowing through the coil. Inductance is proportional to the length of a coil, and rises as the frequency of the driving signal rises. The coil's impedance varies along with the inductance of the coil. In many cases, this rising impedance causes an increasing loss of axial driving force at higher frequencies, which distorts the signal by increasingly removing the upper frequency components, altering both the shape of the waveform and the frequency response. In some cases, the structure of the motor may cause excursion of the coil to modulate its inductance by position, causing an additional intermodulation distortion between low and high frequencies. In many cases, lowering inductance of a motor is preferable. Similarly, in many cases, the modulation of that inductance with position should be minimal.

Distortion in the reproduced waveform can also arise out of the voice coil's own magnetic field as it interacts with the motor's stationary magnetic field. In operation, a voice coil produces a voice coil magnetic field that is directly proportional to the amplitude of an applied speaker signal. The voice coil magnetic field affects the stationary magnetic field across the air gap in at least two ways. First, the voice coil magnetic field may weaken the stationary magnetic field by an amount that is proportional to the amplitude of the driving signal. As the driving signal increases and decreases in amplitude, the voice coil magnetic field modulates the stationary magnetic field, which in turn modulates the axial driving force, causing distortion.

One method of maintaining a flat BL curve at high excursions is taught by U.S. Pat. No. 7,039,213 to Hyre and Wiggins (hereinafter "Hyre"), which is incorporated herein by reference in its entirety. Hyre teaches an electro-mechanical transducer comprising a magnetic assembly that produces a magnetic field having two or more axially displaced regions of greater intensity (generally referred to as "gaps"), the displaced gaps being substantially similar in size, magnitude, and direction, and being separated by and surrounded by regions of lower intensity magnetic field. Hyre teaches that such displaced gaps may be achieved by including opposing grooves in the central pole and the top plate past which the coil moves to transduce sound.

Another method to minimize rising voice coil inductance is to use a fixed multi-turn coil in the gap (a "counter coil"), the counter coil producing a counter magnetic field that reduces the effect of the voice coil magnetic field on the stationary magnetic field. As a result, the counter coil reduces modulation of the stationary magnetic field by the voice coil magnetic field when subjected to the high amplitude speaker signals. Such counter coils are typically made out of multiple turns of wire wound around the pole piece and may be connected in series or in parallel with the voice coil. U.S. Pat. No. 2,004,735, granted to Thomas Jun. 11, 1935, discloses an actively-energized coil to neutralize changes in the gap flux density caused by variations in the field of the voice coil.

It is commonly known that the strength of the stationary magnetic field is inversely proportional to width of the air gap in the motor. Accordingly, it is known to be desirable to minimizing the width of the air gap, thereby strengthening the stationary magnetic field. However, a disadvantage to many previous counter coil implementations is that the air gap must be made wider to accommodate the counter coil.

SUMMARY

In various embodiments of a voice coil motor, as disclosed herein, a magnetic assembly may be configured to produce a magnetic field having two or more axially displaced regions of greater intensity (generally referred to as a "gaps"), separated by and surrounded by regions of lower intensity magnetic field. A voice coil is positioned within the gap and, when driven by an input signal, produces a voice coil magnetic field in the gap. In some embodiments, one or more counter coils circumferentially abut the magnetic gap and are axially aligned with a region of lower magnetic intensity, such that when driven by an input signal, the counter coil(s) produce in the magnetic gap a magnetic field counter to the voice coil magnetic field.

DESCRIPTION

Figure 1:
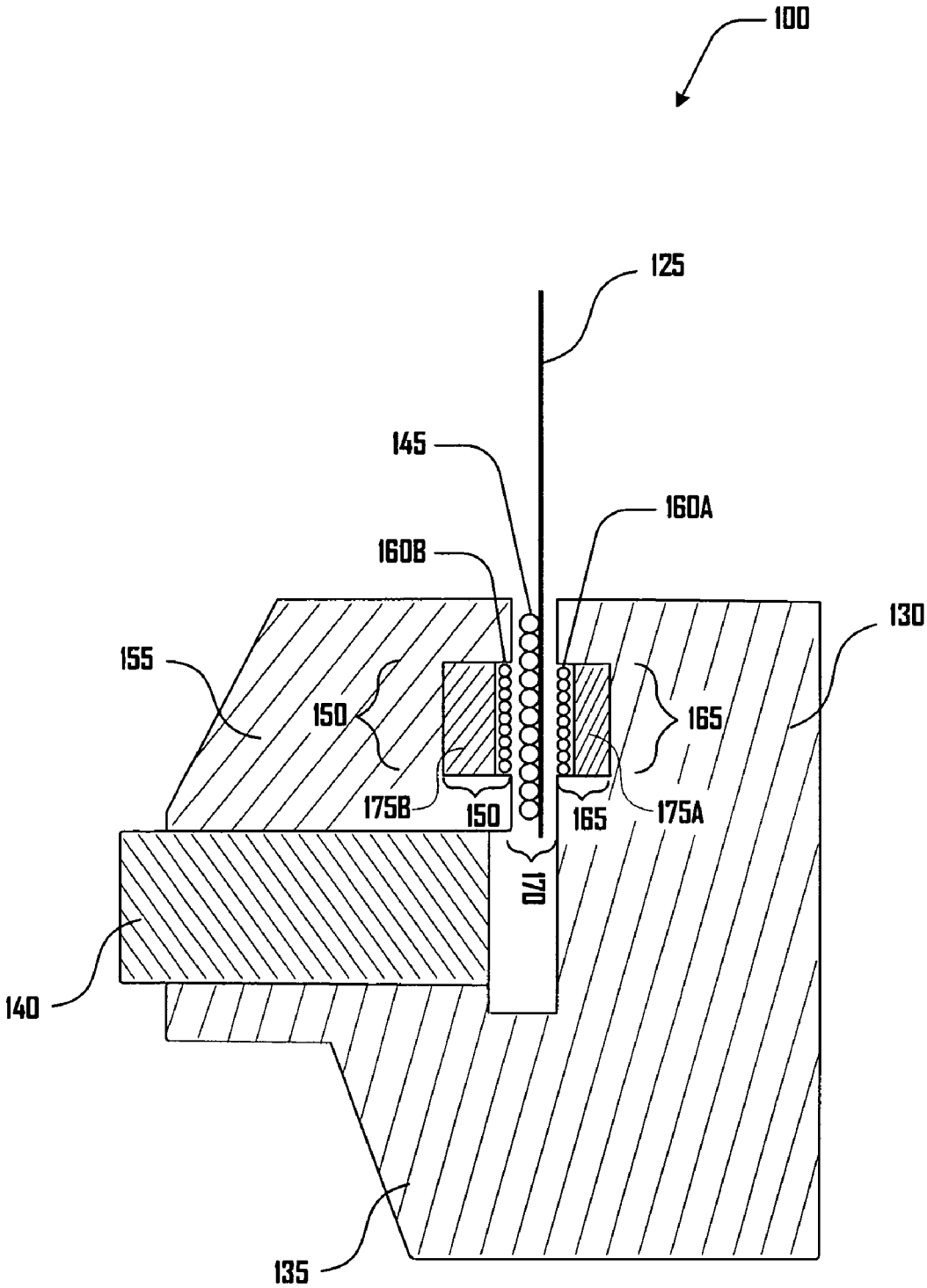
FIG. 1 depicts a cross-sectional view of the core of a voice coil motor in accordance with one embodiment.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

FIG. 1 illustrates a simplified cross section of the core of a voice coil motor in accordance with one embodiment. FIG. 1 and many of the other drawings herein are not precisely to scale. Rather, certain components have been resized and/or moved to better illustrate various exemplary embodiments. The core includes a magnetic assembly comprising a back plate 135, pole piece 130, magnetic material 140, and a front plate 155. The front plate 155 has a groove 150 or recess on its surface that faces the voice coil 145. The pole piece 130 has an opposing groove 165 or recess on its surface that faces the voice coil 145. In a typical embodiment, the voice coil 145 is wound on a former or bobbin 125 that moves axially in the air gap 170, the space between the front plate 155 and the pole piece 130.

Figure 9:
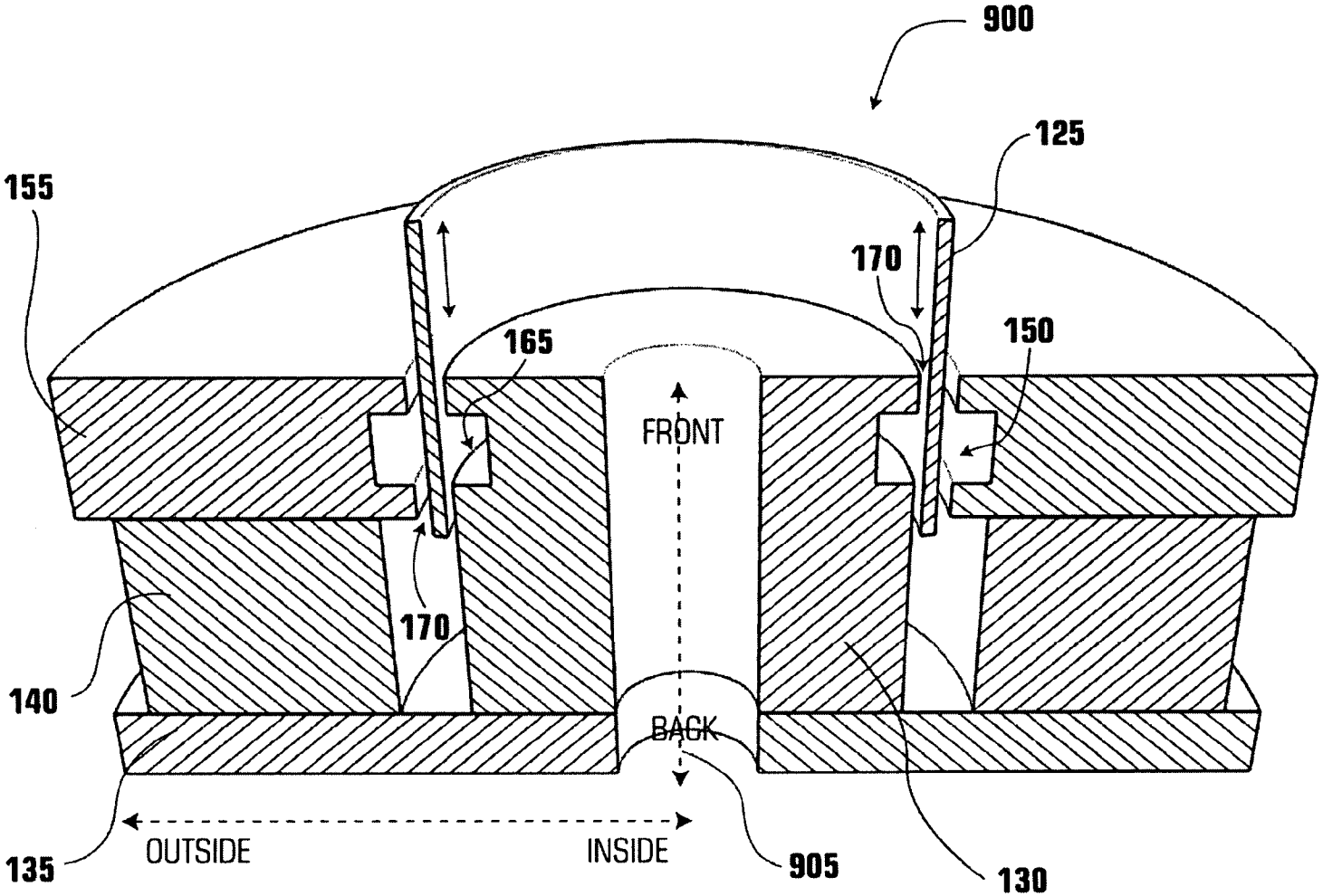
FIG. 9 illustrates a cross section of a 3-dimensional rendering of a simplified magnetic assembly and bobbin in accordance with one embodiment.

FIG. 9 illustrates many of these elements in a cross section of a 3-dimensional rendering of a simplified magnetic assembly 900 and bobbin 125 in accordance with one embodiment. Although other designs are possible, the exemplary magnetic assembly 900 illustrates that the back plate 135, pole piece 130, magnetic material 140, and front plate 155, are generally cylindrical structures, and that the exemplary front plate 155 has a central opening through which at least part of the pole piece 130 projects. The central opening of the front plate 155 is larger in diameter than the pole piece, forming a cylindrical air gap 170. In many embodiments, some or all of the back plate 135, pole piece 130, and front plate 155 may be formed from steel. In other embodiments, other magnetically conductive materials may be used, such that the back plate 135, pole piece 130, magnetic material 140, and front plate 155 are magnetically coupled to form a magnetic field passing through the air gap 170 (see FIG. 10, discussed below). Thus, in response to an electrical signal sent to the voice coil (not shown in FIG. 9), the bobbin 125 may move through the air gap 170 along a front-back axis 905. The exemplary magnetic assembly 900 includes central openings in the pole piece 130 and back plate 135, but other embodiments may use a solid pole piece 130 and/or back plate 135.

Figure 10:
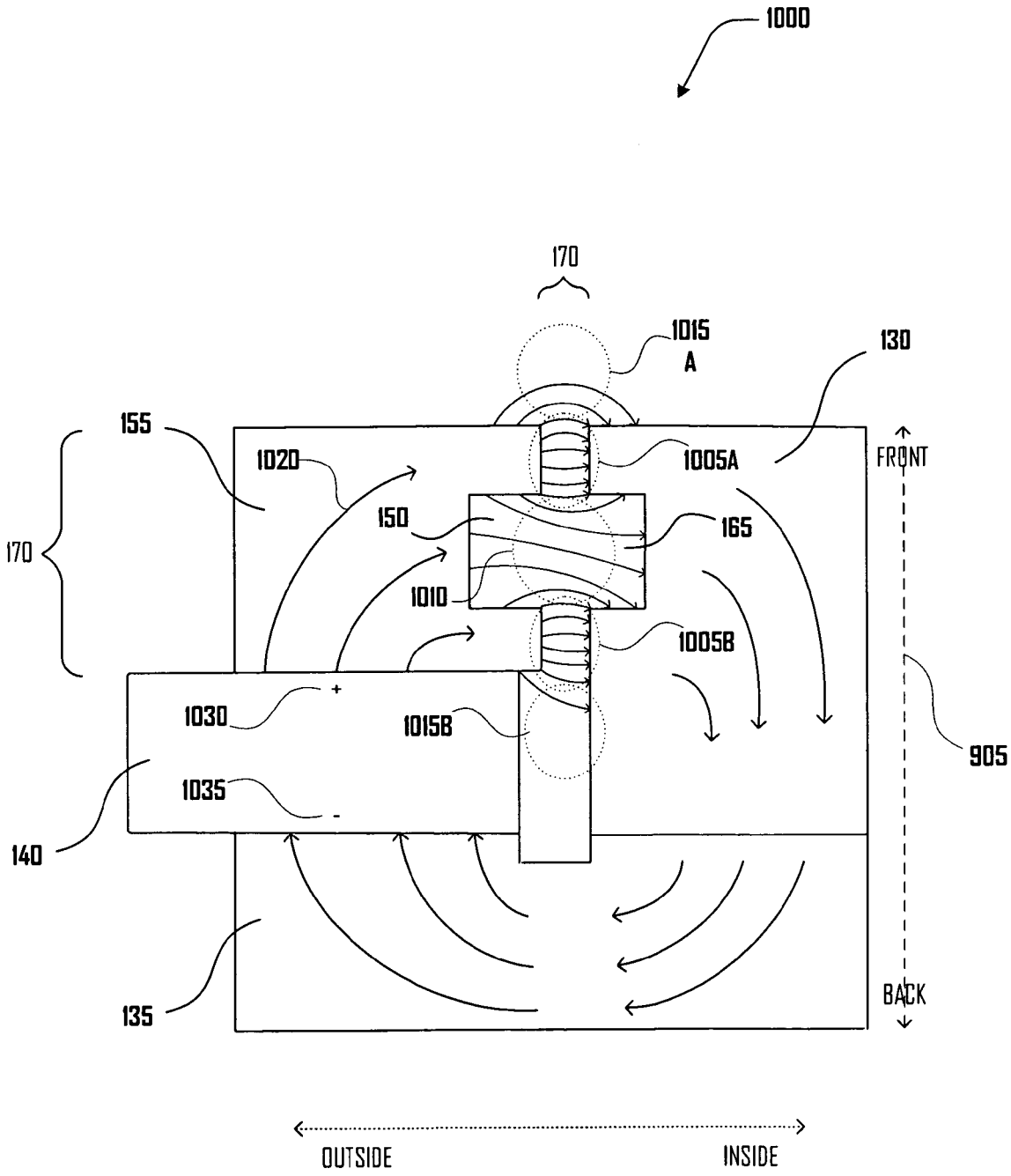
FIG. 10 depicts a simplified cross-section of a primary magnetic field formed by a magnetic assembly in accordance with one embodiment.
Figure 11:
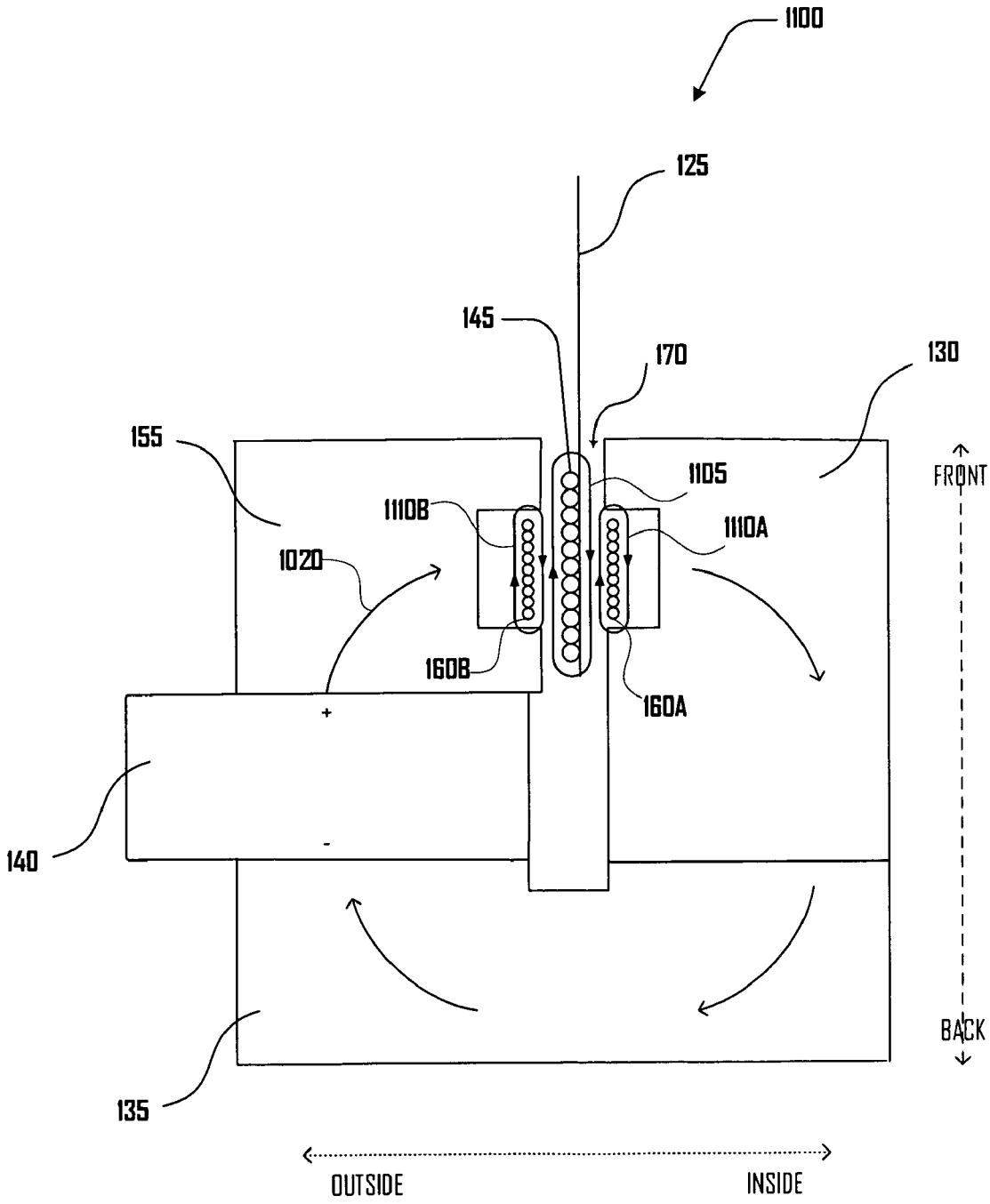
FIG. 11 depicts a simplified conceptual model of the magnetic fields produced by an electrical input signal to a voice coil and one or more counter coils in accordance with one embodiment.

Regarding the front-back axis 905, FIGS. 9-11 depict a dashed line 905, which has no structural or functional significance and is used merely as a convenient point of reference for describing relationships of various components depicted therein. Similarly, FIGS. 9-11 also depict a non-functional, non-structural dotted line referring to the "inside" and "outside" of the magnetic assembly. This dotted line is merely to help visually relate FIG. 9 to the 2-dimensional cross sections depicted in FIGS. 10-11.

Figure 2:
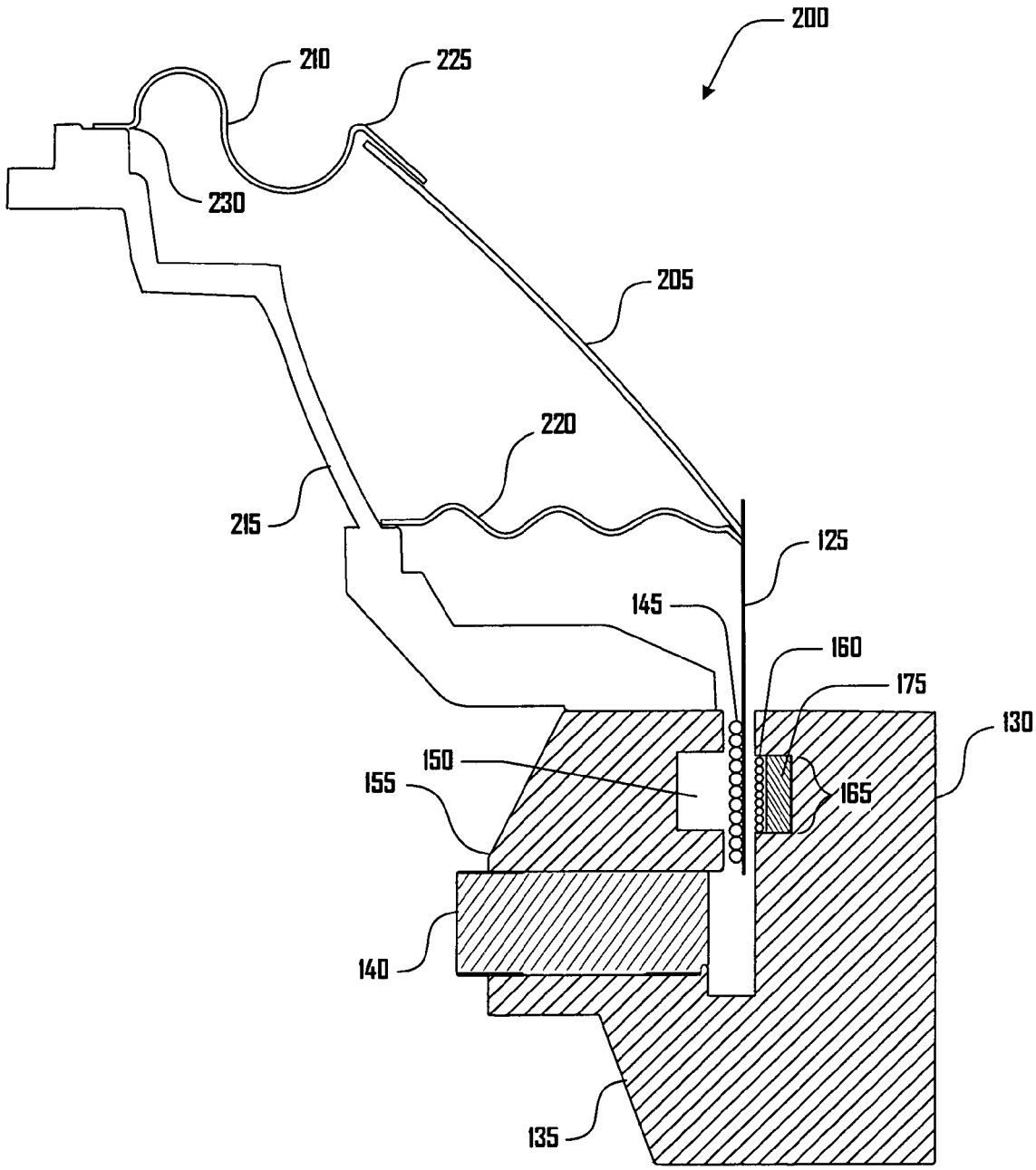
FIG. 2 depicts a simplified cross-sectional view of the voice coil motor of FIG. 1 forming the motor of a loudspeaker driver in accordance with one embodiment.
Figure 3:
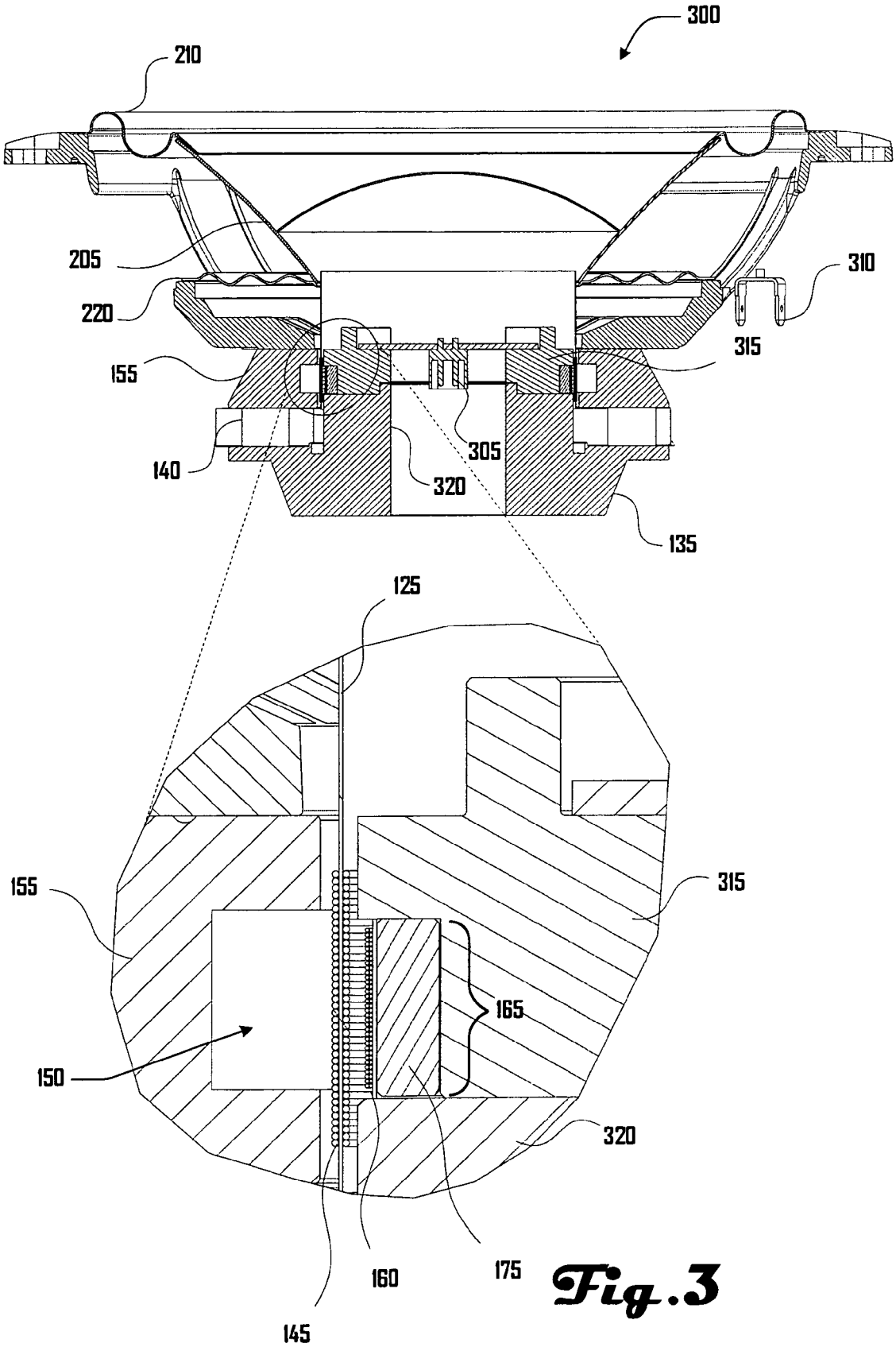
FIG. 3 depicts a detailed cross-sectional view of a loudspeaker driver in accordance with one embodiment.
Figure 4:
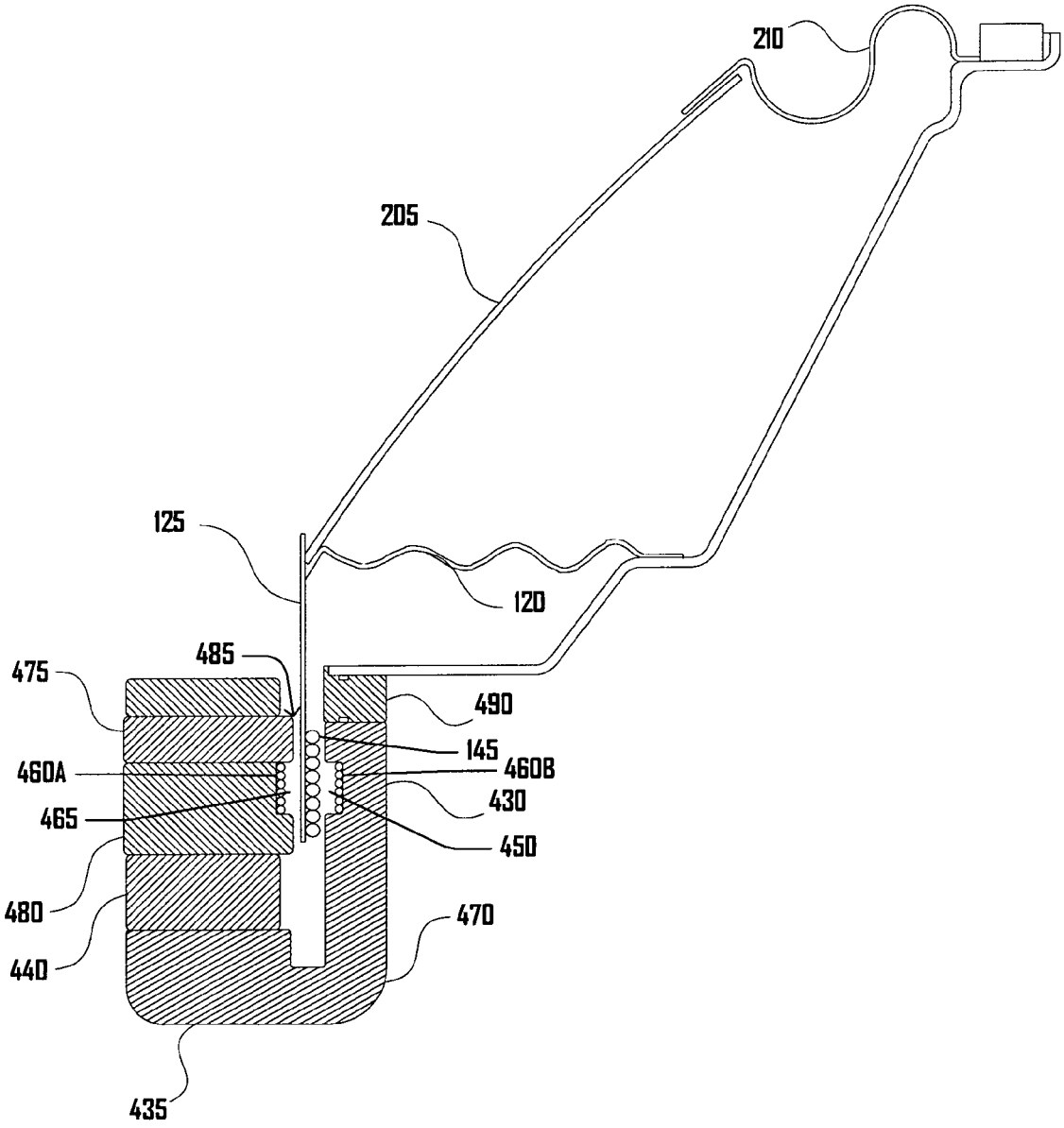
FIG. 4 depicts a simplified cross-sectional view of an alternate design of a loudspeaker driver in accordance with one embodiment.
Figure 5:
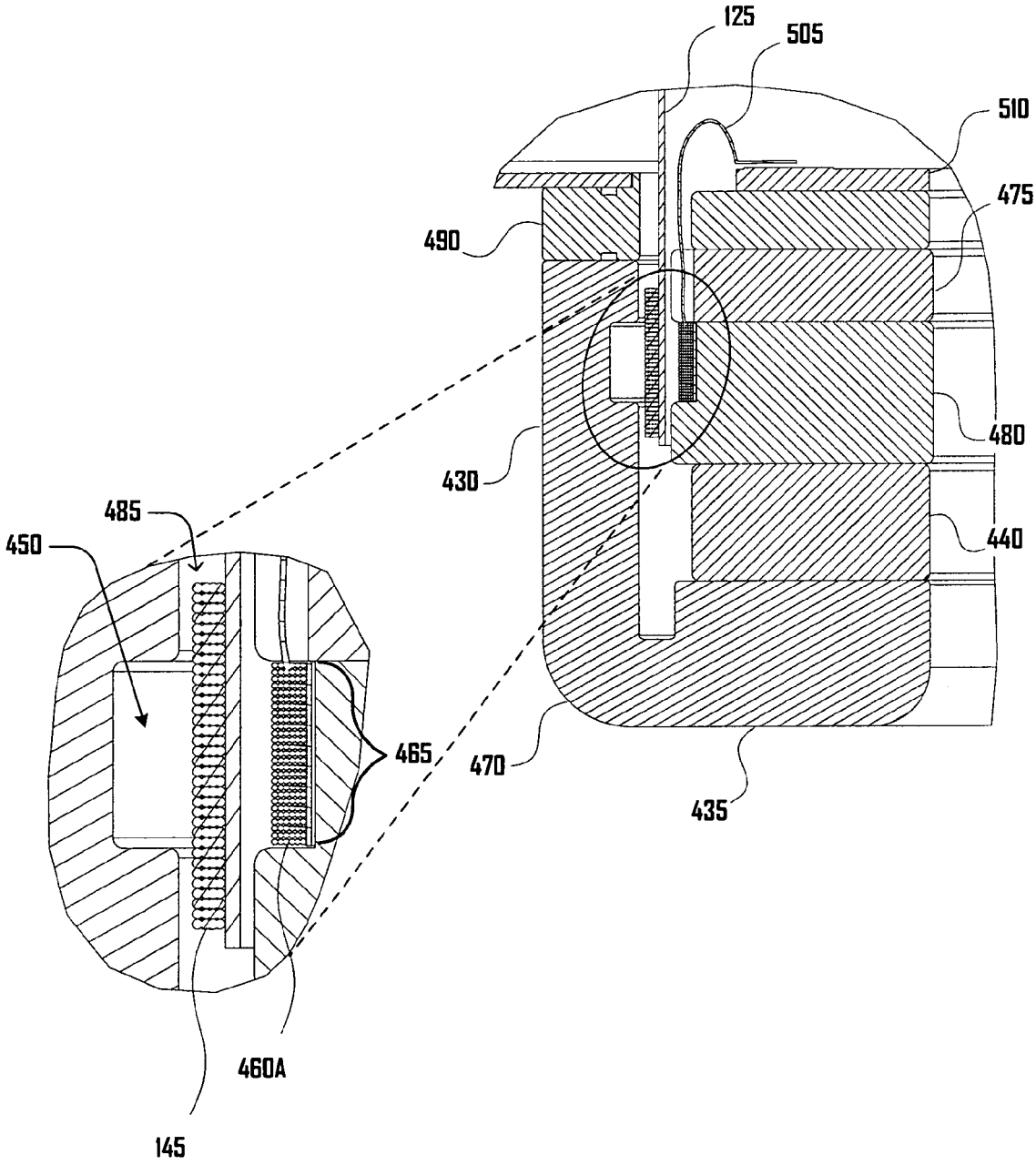
FIG. 5 depicts a detailed cross-sectional view of the motor of the loudspeaker driver of FIG. 4 in accordance with one embodiment.

In some embodiments, the pole piece 130 and back plate 135 may form a single component (see, e.g., the embodiments illustrated in FIGS. 1-3, as well as the cup-style motor embodiments illustrated in FIGS. 4 and 5).

Magnetic material 140 has magnetic poles (not shown) aligned substantially along the front-back axis 905. In an exemplary embodiment, magnetic material 140 is a permanent magnet, such as a ceramic, ferrite, alnico, or rare-earth magnet. Other embodiments may utilize other sources of magnetism, including electromagnets. In some embodiments, magnetic material 140 may not be a single contiguous cylindrical structure, as illustrated. For example, several discrete pieces of magnetic material may be distributed around the circumference of the back plate 135, such that a substantially uniform magnetic field is formed around the circumference of the air gap 170. (In such an embodiment, the magnetic field in the air gap varies in intensity along the front-back axis, as illustrated in FIG. 10. But at a given point along the front-back axis, the intensity of the magnetic field is substantially uniform around the circumference of the air gap.)

Also illustrated in FIG. 9 is groove 165, which passes circumferentially around the outer surface of the pole piece (hereinafter "pole piece surface groove" 165), and groove 150, which passes circumferentially around the inner surface of the central opening in the front plate 155 (hereinafter "front plate surface groove" 150). In various embodiments, one or more counter coils 160 (not shown in FIG. 9) and/or spacer rings (not shown in FIG. 9) may be disposed in one or both surface grooves 150, 165.

FIG. 10 shows a simplified cross-section of a primary magnetic field formed by magnetic material 140 magnetically coupled to the back plate 135, pole piece 130, and front plate 155 in accordance with one embodiment. In FIG. 10, the positive pole 1030 has been illustrated towards the front plate, and the negative pole 1035 has been illustrated towards the rear plate 135. However, in other embodiments, the poles may be reversed. FIG. 10 is merely a visual aid to help the reader conceptually understand the spatial relationships between the illustrated structures and the illustrated magnetic fields; FIG. 10 does not depict an accurate magnetic model of a magnetic assembly.

In FIG. 10, the primary magnetic field is indicated by flux lines 1020, which conceptually illustrate the magnetic field between one pole 1030 of the magnetic material 150 and the other pole 1035 of the magnetic material 140. In the region along the air gap 170, the relative intensity of the magnetic field, which varies along the front-back axis 905, is conceptually suggested by the density of the flux lines 1020. For example, region 1005A is depicted as a region of greater magnetic intensity as compared to neighboring regions of lesser magnetic intensity 1015A and 1010. (For purposes of illustration only, regions 1005-1015 are depicted as dotted ovals.) Thus, lesser intensity region 1010 separates greater intensity regions 1005A and 1005B. Lesser intensity regions 1015A and 1015B surround the regions of greater magnetic intensity 1005A-B within the air gap 170.

Regions 1005-1015 in and around the air gap 170 may alternately be characterized in terms of magnetic resistance, or reluctance, which varies inversely with the intensity of the magnetic field in the region. For example, regions 1005A-B exhibit lower reluctance than higher reluctance regions 1010 and 1015A-B. Accordingly, the regions of lower reluctance 1005A-B focus or concentrate the magnetic field in the air gap 170 into regions of higher intensity. In some embodiments, an external magnetic field (not shown) may also extend outside the magnetic assembly.

The intensity of the primary magnetic field in the air gap 170 may vary widely in various embodiments. In some embodiments, higher intensity regions 1005A and 1005B may exhibit magnetic intensities of as little as 1000 Gauss. In many embodiments, higher intensity regions 1005A and 1005B may exhibit much higher magnetic intensities. As illustrated in FIG. 10, higher intensity regions 1005A and 1005B have magnetic flux in substantially similar directions. In many embodiments, higher intensity regions 1005A and 1005B are of similar size and intensity. In other embodiments, higher intensity regions 1005A and 1005B may differ in size and/or intensity from one another. In some embodiments, lesser intensity region 1010 may exhibit a magnetic intensity of up to 90% of the intensity of one or more of higher intensity regions 1005A and 1005B.

Referring again to FIG. 1, in an exemplary embodiment, the pole piece surface groove 165 contains an inner spacer ring 175A, on which is wound an inner counter coil 160A. Similarly, the front plate surface groove 150, contains an outer spacer ring 175B, on which is wound an outer counter coil 160B. In various embodiments, a spacer ring 175 and/or counter coil 160 may be present in either one or both surface grooves 150, 165. However, to simplify the drawings and description, only the inner counter coil 160A and spacer ring 175A are illustrated and discussed in the remaining figures.

A spacer ring 175, when present, may be made of any non-magnetic or para-magnetic material. A counter coil 160 is typically made from copper wire, as is the voice coil 145. In other embodiments, other conductive materials may be used, e.g. gold, silver, aluminum, and the like.

Figure 7:
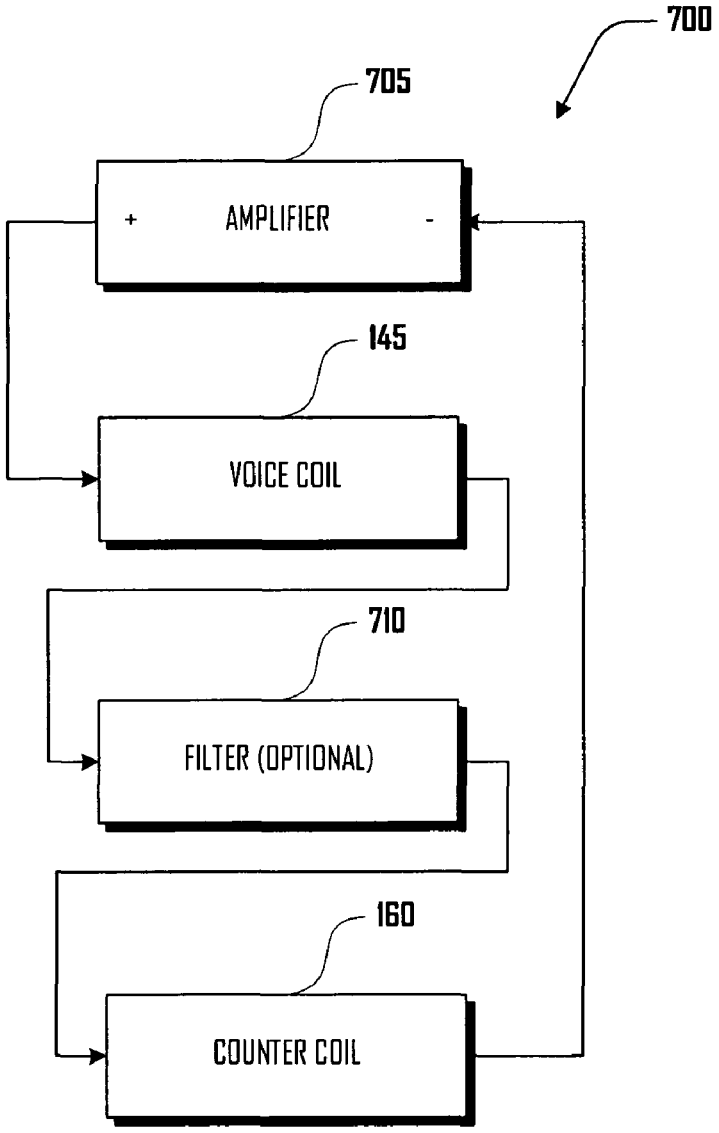
FIG. 7 is a diagram illustrating the voice coil 145 and the counter coil 160 connected in series in accordance with one embodiment.
Figure 8:
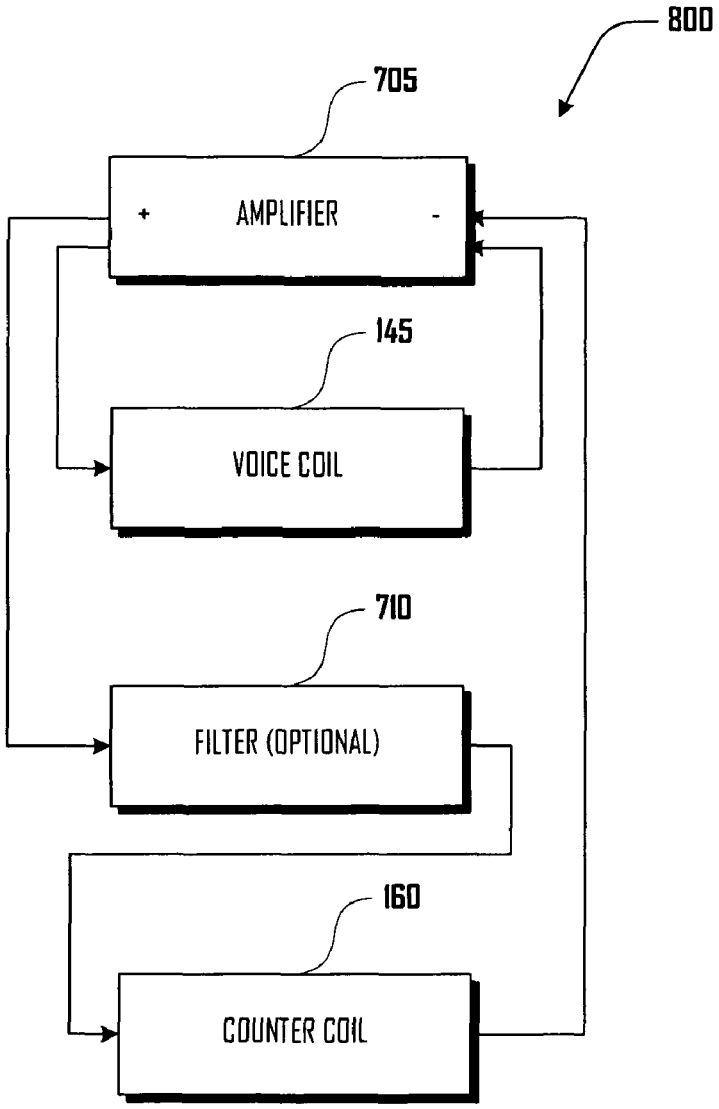
FIG. 8 is a diagram illustrating the voice coil 145 and the counter coil 160 connected in parallel in accordance with one embodiment.

In one embodiment, both the voice coil 145 and the counter coil(s) 160 terminate in leads that are connected to a source of power (typically an amplifier 705). As illustrated FIGS. 7 and 8, a voice coil 145 and counter coil(s) 160 may be connected in series (FIG. 7) or in parallel (FIG. 8). In some embodiments, current is made to flow through a counter coil 160 in the opposite direction from the current flowing through the voice coil 145. Consequently, the magnetic field generated by the counter coil 160 acts to diminish the voice coil magnetic field in the gap.

In an exemplary embodiment, a counter coil 160 is wound from wire of a smaller gauge than that of the voice coil 145. In one embodiment, a counter coil 160 dissipates no more than 30-40% of the power dissipated by the voice coil 145. Accordingly, in an exemplary embodiment, when the counter coil 160 is connected in parallel with the voice coil 145, the resistance of the counter coil 160 may be less then approximately 33% of the resistance of the voice coil 145. Moreover, in an exemplary embodiment, the inductance of the counter coil 160 may be approximately 70-140% of the inductance of the voice coil 145 (i.e., the ratio of inductance between the counter coil 160 and the voice coil is between about $\sqrt{2}$:1 and $$\frac{1}{\sqrt{2}}:1).$$

In an exemplary embodiment, the DC resistance of the voice coil 145 may be approximately 8 Ohms, the DC resistance of the counter coil 160 may by approximately 24 Ohms, and the DC resistance of the two coils connected in parallel may be approximately 6 Ohms. In alternate embodiments, the counter coil 160 may be connected in series with the voice coil 145.

FIG. 11 illustrates a simplified conceptual model of the magnetic fields produced by an electrical input signal to a voice coil 145 and one or more counter coils 160A-B in accordance with one embodiment. In various embodiments, either one or both of counter coils 160A and 160B may be present. FIG. 11 is merely a visual aid to help the reader conceptually understand various relationships between the illustrated structures and their associated magnetic fields; FIG. 11 does not depict an accurate magnetic model of the illustrated structures.

When an electrical input signal is applied to the voice coil 145, the current in the voice coil 145 generates a voice coil magnetic field, indicated by flux line 1105. Similarly, current in a counter coil 160A-B generates a counter magnetic field, indicated by flux line 110A-B. The counter magnetic field is configured to oppose the voice-coil magnetic field in the air gap 170 such that the magnetic field resulting from the interaction of the voice-coil magnetic field and counter magnetic field is weaker than the voice-coil magnetic field for at least a part of the audible frequency range. Thus, a counter coil 160A-B produces a counter magnetic field that reduces the extent to which a voice-coil magnetic field modulates the primary magnetic field (indicated by grossly simplified flux lines 1020) in the air gap 170. (To simplify and clarify the drawing, regions of the primary magnetic field within the air gap 170 are not depicted in FIG. 11.) In one embodiment, the intensity of the counter magnetic field may be as little as 5% of the intensity of the voice-coil magnetic field. In other embodiments, the counter magnetic field may be at least 33% of the intensity of the voice-coil magnetic field.

Comparing FIGS. 10 and 11, counter coil(s) 160A and/or 160B may be seen to reside within the region of lower magnetic intensity 1010 separating regions of higher magnetic intensity 1005A-B. By placing the counter coil 160 in the region of lesser intensity magnetic field, the counter coil 160 may, in one embodiment, be optimally positioned in the middle of the voice coil's excursion stroke. Moreover, in one embodiment, by positioning a counter coil 160A and/or 160B in a surface groove in the pole piece 130 and/or front plate 155, BL is not substantially diminished by widening the air gap 170 to make room for a counter coil 160A and/or 160B.

In various embodiments, a counter coil 160A and/or 160B may be caused to generate a counter magnetic field that opposes the voice coil magnetic field 1105 via (i) configuring the electrical input signal applied to the counter coil and/or (ii) configuring the physical layout of the coil.

In some embodiments, a signal filter (e.g. filter 710, see FIG. 7) may alter the electrical input signal to shape the response of a counter coil 160. A signal filter may operate in the digital and/or analog domain to shape the electrical input signal to the counter coil 160. In one embodiment, a counter coil 160 is wound in the same direction as the voice coil 145, and the filter 710 comprises an allpass filter configured to invert the phase of the electrical signal above a particular frequency. In such an embodiment, the counter coil 160 may work in concert with the voice coil 145 at low frequencies, increasing the low frequency efficiency of the system, while acting to control rising inductance at high frequencies. The frequency and phase response of the electrical signals provided to a counter coil 160 and/or the voice coil 145 may also be altered by one or more active and/or passive, analog and/or digital shaping networks.

FIG. 2 depicts a simplified cross-sectional view of the voice coil actuator of FIG. 1, in context of the motor of a loudspeaker driver, in accordance with one embodiment. The voice coil bobbin 125 is affixed to an acoustic radiating diaphragm 205 and a suspending element 220 (or spider). The front plate 155 is affixed to a supporting frame 215. The front edge of the diaphragm 205 is sealed to the frame 215 by a flexible surround 210. Flexible surround 210 differs from previously known surrounds in that its profile is an "inverted S" shape, having an acute angle 225 at the terminus of the diaphragm 205 and an approximately 90° angle 230 where flexible surround 210 couples to the frame 215. Non-inverted S-shaped surrounds are well known in the art. However, previously known Non-inverted S-shaped surrounds have an obtuse angle at the edge of the diaphragm 205. It has been observed that the acute angle 225 of the inverted S surround 210 advantageously damps edge resonances in the diaphragm 205 better than an obtuse angle, as in non-inverted S-shaped surrounds. Moreover, in some embodiments, the mechanical impedances of angles 225 and 230 in an inverted S-shaped surround may differ less than the corresponding angles in non-inverted S-shaped surrounds, leading to further improved performance.

FIG. 3 depicts a detailed cross-sectional view of a loudspeaker driver 300 in accordance with one embodiment. A terminal 310 is provided to connect the voice coil 145 to an amplifier. A separate terminal 305 is provided to connect the counter coil 160 to the amplifier. In an alternate embodiment, the counter coil 160 may be connected to its own amplifier. In this embodiment, a counter coil yoke 315 is positioned atop the pole piece 320, the two pieces acting together to form displaced regions of greater-intensity magnetic field.

FIG. 4 depicts a simplified cross-sectional view of an alternate design of a loudspeaker driver in accordance with one embodiment. In this embodiment, the motor structure includes a magnetically conductive cup style yoke 470 which includes a cylindrical portion 430 and a back plate portion 435. A permanent magnet 440 is magnetically coupled to the back plate 435, and a magnetically conductive counter coil yoke 480 and front plate 475 is magnetically coupled to the permanent magnet 440. The counter coil yoke 480, front plate 475, and the cylindrical portion of the cup 430 define a magnetic air gap 485 within which the voice coil 145 travels. In one embodiment, a secondary permanent magnet 490 may be utilized to achieve the desired magnetic flux. The cylindrical portion 430 includes a groove 450 that, along with the opposing recess 465 (formed by the counter coil yoke 480 and front plate 475), form displaced regions of greater-intensity magnetic field. In one embodiment, a first counter coil 460A is wound around the counter coil yoke 480 in the region of lesser-intensity magnetic field, and a second counter coil 460B is wound in groove 450 in the region of lesser-intensity magnetic field. In other embodiments, only one of first counter coil 460A or second counter coil 460B may be present.

FIG. 5 depicts a detailed cross-sectional view of the motor of the loudspeaker driver of FIG. 4 in accordance with one embodiment. In this embodiment, the voice coil 145 and first counter coil 460A are wound with multiple layers of wire. In other embodiments, second counter coil 460B may be present in groove 450. Counter coil leads 505 are wired into a PCB board 510 atop the motor.

Figure 6:
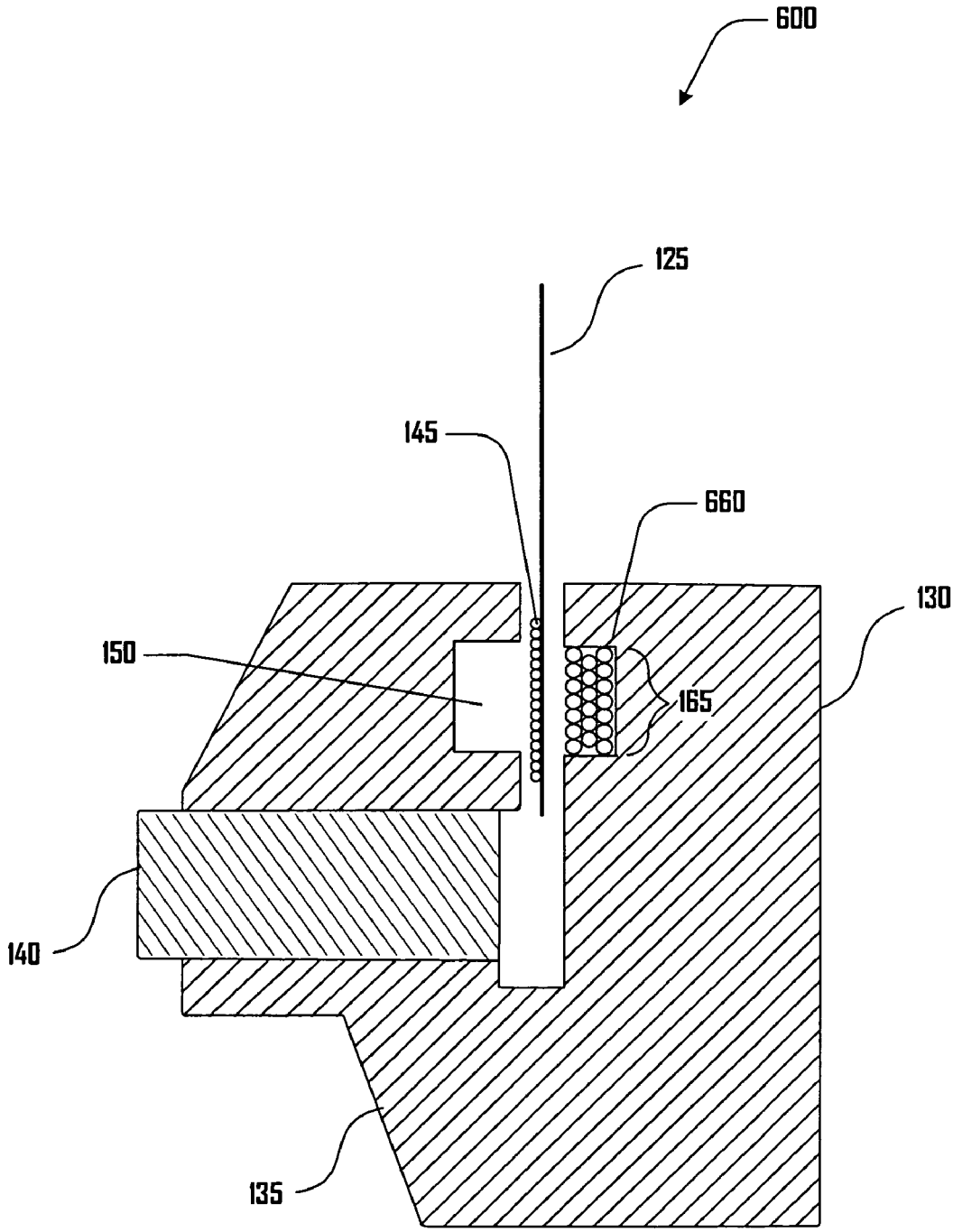
FIG. 6 depicts a simplified cross-section of an alternate embodiment.

FIG. 6 depicts a simplified cross-section of an alternate embodiment. In this embodiment, no spacer ring is used in the pole piece surface groove 165. Rather, counter coil 660 is formed using large gauge wire wound within pole piece surface groove 165. In many embodiments, the large gauge wire may be sized so that the outer surface of the coil 660 is flush with the air gap 170, and so that an appropriate number of turns are used to obtain a desired inductance value (e.g., roughly comparable to the inductance of the voice coil 125). The DC resistance of such large gauge wire would be relatively low, so in many embodiments, the counter coil 660 would likely be connected in series with the voice coil 145.

Figure 12:
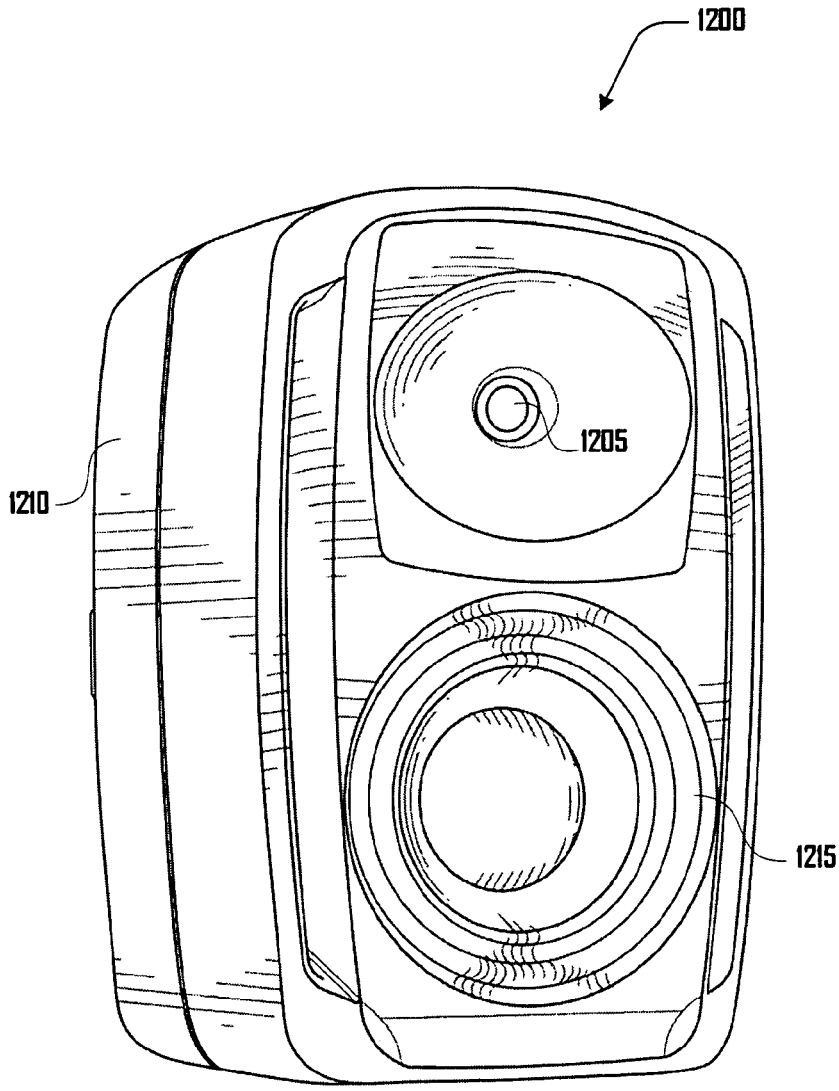
FIG. 12 depicts a loudspeaker system in accordance with one embodiment.

FIG. 12 depicts a loudspeaker system 1200 in accordance with one embodiment. The exemplary loudspeaker system 1200 includes a high frequency transducer 1205 and a mid- and/or low-frequency transducer 1215 (see, e.g., FIGS. 2-5) mounted in an enclosure 1210. In various embodiments, one or more of high-frequency transducer 1205 and mid- and/or low-frequency transducer 1215 may include a motor embodying some or all of the disclosures provided herein. In many embodiments, loudspeaker system 1200 may include more or fewer transducers and may include additional components (not shown), such as one or more active or passive frequency response shaping networks; a vent, passive radiator, or other mass-loaded resonant device, one or more electrical signal amplifiers, and the like.

Although specific embodiments have been illustrated and described herein, it will be appreciated by those of ordinary skill in the art that a whole variety of alternate and/or equivalent implementations may be substituted for the specific embodiments shown and described without departing from the scope of the present disclosure. For example, the voice coil motors described herein may be implemented in accordance with any type of voice-coil-driven system, including solenoids and hard disk head actuators. This application is intended to cover any adaptations or variations of the embodiments discussed herein.

The invention claimed is:

1. An actuator for moving a voice coil in response to an input signal, the actuator comprising:

a magnetic assembly, substantially symmetrically disposed about a central axis, that comprises a back plate, magnetic material, a front plate having a central opening, and a central pole that extends at least partially through the central opening, the magnetic material producing a primary magnetic field that extends through a magnetic gap separating the central pole and the central opening, wherein the central opening comprises a first surface groove abutting the magnetic gap, and the central pole comprises a circumferential second surface groove abutting the magnetic gap opposite the first surface groove, wherein the central opening and the central pole configure the primary magnetic field in the magnetic gap into regions of greater and lesser magnetic intensity along the central axis, at least one region of lesser magnetic intensity being axially disposed between at least two regions of greater magnetic intensity;

a voice coil that is movably positioned within the magnetic gap and that, in response to the input signal, produces a voice coil magnetic field in the magnetic gap; and a counter coil that circumferentially abuts the magnetic gap and is axially aligned with the region of lesser magnetic intensity, the counter coil producing, in response to the input signal, a counter magnetic field in the magnetic gap.

2. The actuator of claim 1, wherein the said counter magnetic field interacts with the voice coil magnetic field such that a resultant magnetic field is lesser in magnitude than the voice coil magnetic field across at least a portion of the audible frequency spectrum.

3. The actuator of claim 2, further comprising a phase-shifting filter to filter the input signal provided to the counter coil.

4. The actuator of claim 3, wherein the resultant magnetic field is lesser in magnitude than the voice coil magnetic field only at frequencies above a filter frequency.

5. The actuator of claim 1, further comprising a signal inverter to invert the input signal provided to the counter coil.

6. The actuator of claim 1, wherein the counter coil is fixedly disposed within a selected at least one of the first and second surface grooves.

7. The actuator of claim 6, further comprising a non-magnetic or paramagnetic spacer ring disposed within the selected at least one surface groove to substantially abut a circumferential surface of the counter coil on the magnetic gap.

8. The actuator of claim 1, wherein the counter coil comprises a pair of counter coils on opposing sides of the magnetic gap.

9. The actuator of claim 1, wherein a ratio of inductance between the counter coil and the voice coil is between about $\sqrt{2}$:1 and $$\frac{1}{\sqrt{2}}:1.$$

10. The actuator of claim 1, wherein a ratio of resistance between the counter coil and the voice coil is greater than 3:1.

11. The actuator of claim 10, wherein the voice coil and the counter coil are electrically connected in parallel such that a combined direct current ("DC") resistance is between about 4-8 Ohms.

12. The actuator of claim 1, wherein the voice coil and the counter coil are electrically connected in series and a ratio of resistance between the voice coil and the counter coil is greater than 3:1.

13. The actuator of claim 1, wherein an intensity of the counter magnetic field is greater than 1/20 of an intensity of the voice coil magnetic field.

14. The actuator of claim 13, wherein the intensity of the counter magnetic field is about 1/3 of the intensity of the voice coil magnetic field.

15. The actuator of claim 1, wherein an intensity of the at least one region of lesser magnetic intensity is less than 90% of an intensity of the plurality of regions of greater magnetic intensity in the primary magnetic field.

16. The actuator of claim 1, wherein an intensity of the plurality of regions of greater magnetic intensity in the primary magnetic field is at least 1000 Gauss.

17. The actuator of claim 1, wherein the central pole is formed from steel.

18. The actuator of claim 1, further comprising an acoustic-radiating diaphragm coupled to the voice coil and flexibly coupled to a supporting frame.

19. The actuator of claim 18, further comprising an enclosure coupled to the supporting frame to at least partially enclose the actuator.

* * * * *